US012557888B2

(12) United States Patent
Karl et al.

(10) Patent No.: US 12,557,888 B2
(45) Date of Patent: Feb. 24, 2026

(54) LUGGAGE ARTICLE ATTACHMENT MEMBER

(71) Applicant: Samsonite IP Holdings S.a r.l., Luxembourg (LU)

(72) Inventors: Philip Justin Karl, Rehoboth, MA (US); Ulliyada Bopanna, Milton, MA (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 389 days.

(21) Appl. No.: 18/077,146

(22) Filed: Dec. 7, 2022

(65) Prior Publication Data

US 2023/0098874 A1 Mar. 30, 2023

Related U.S. Application Data

(63) Continuation-in-part of application No. 17/546,167, filed on Dec. 9, 2021, now Pat. No. 12,225,991.

(60) Provisional application No. 63/182,580, filed on Apr. 30, 2021.

(51) Int. Cl.

| | |
|---|---|
| ***A45C 13/28*** | (2006.01) |
| ***A45C 5/03*** | (2006.01) |
| ***A45C 13/00*** | (2006.01) |
| ***A45C 13/26*** | (2006.01) |

(52) U.S. Cl.

CPC ..... *A45C 13/28* (2013.01); *A45C 5/03* (2013.01); *A45C 13/005* (2013.01); *A45C 13/262* (2013.01); *A45C 2005/037* (2013.01); *A45C 2013/267* (2013.01)

(58) Field of Classification Search

CPC ..... A45C 13/28; A45C 5/03; A45C 13/005; A45C 13/262; A45C 2005/037; A45C 2013/267; A45C 13/001; A45C 15/00; A45C 13/38

USPC ..... 190/108

See application file for complete search history.

(56) References Cited

U.S. PATENT DOCUMENTS

| | | | | |
|---|---|---|---|---|
| 4,122,925 | A * | 10/1978 | Schultheiss | A45C 15/00 190/108 |
| 4,550,813 | A | 11/1985 | Browning | |
| 4,759,431 | A | 7/1988 | King et al. | |
| 4,817,769 | A | 4/1989 | Saliba | |

(Continued)

FOREIGN PATENT DOCUMENTS

| | | | |
|---|---|---|---|
| CN | 2239741 | Y | 11/1996 |
| CN | 2290223 | Y | 9/1998 |

(Continued)

OTHER PUBLICATIONS

Extended European Search Report for European Patent Application No. 23214873.4 dated Apr. 18, 2024, 8 pages.

*Primary Examiner* — Don M Anderson
*Assistant Examiner* — Justin Caudill
(74) *Attorney, Agent, or Firm* — Dorsey & Whitney LLP

(57) ABSTRACT

In one embodiment, a luggage case is disclosed. The luggage case includes a main body including a lid shell and a base shell. The lid shell and the base shell are hingedly coupled to one another and selectively closable by a closure mechanism. The luggage case further includes a primary recess, the primary recess defining a bottom wall. A secondary recess is formed in the bottom wall of the primary recess and an attachment member is positioned in the secondary recess.

19 Claims, 10 Drawing Sheets

(56) References Cited

U.S. PATENT DOCUMENTS

| | | | | |
|---|---|---|---|---|
| 4,993,526 | A | 2/1991 | Morrison | |
| 5,311,972 | A * | 5/1994 | Plath | A45C 3/004 190/110 |
| 5,323,886 | A * | 6/1994 | Chen | A45C 5/143 280/655 |
| 5,501,308 | A | 3/1996 | King | |
| 5,762,169 | A | 6/1998 | Deliman et al. | |
| 5,842,673 | A | 12/1998 | Fenton | |
| 6,141,841 | A | 11/2000 | Workman | |
| 6,213,266 | B1 | 4/2001 | Hollingsworth | |
| 6,216,322 | B1 | 4/2001 | Kuo | |
| 6,347,693 | B1 | 2/2002 | Chen | |
| 6,640,400 | B1 * | 11/2003 | Chen | A45C 13/1076 24/651 |
| 7,559,115 | B2 | 7/2009 | Tong et al. | |
| D777,437 | S | 1/2017 | Stone | |
| 9,638,572 | B2 | 5/2017 | Moon | |
| 10,349,717 | B2 | 7/2019 | Hamzaee et al. | |
| 10,631,607 | B2 | 4/2020 | Yu | |
| 2003/0042090 | A1 | 3/2003 | Wang | |
| 2003/0066170 | A1 | 4/2003 | Huang | |
| 2004/0084269 | A1 | 5/2004 | Wang | |
| 2004/0211634 | A1 * | 10/2004 | Chan | A45C 7/0045 190/18 A |
| 2006/0102677 | A1 | 5/2006 | Nassanian | |
| 2010/0307878 | A1 | 12/2010 | Giglio | |
| 2015/0034440 | A1 | 2/2015 | Lai | |
| 2015/0040622 | A1 | 2/2015 | Meersschaert et al. | |
| 2018/0125192 | A1 * | 5/2018 | Meersschaert | A45C 13/262 |
| 2018/0279730 | A1 | 10/2018 | Yu | |
| 2019/0274402 | A1 * | 9/2019 | Schultz | A45C 11/20 |
| 2019/0373997 | A1 | 12/2019 | Lee | |
| 2020/0170368 | A1 * | 6/2020 | Korey | A45C 15/00 |
| 2022/0346514 | A1 | 11/2022 | Karl et al. | |
| 2023/0098364 | A1 | 3/2023 | Karl et al. | |

FOREIGN PATENT DOCUMENTS

| | | | | |
|---|---|---|---|---|
| CN | 2484794 | Y | 4/2002 | |
| CN | 206866804 | U | 1/2018 | |
| CN | 108669742 | A | 10/2018 | |
| CN | 108884853 | A | 11/2018 | |
| CN | 110621189 | B | 7/2021 | |
| DE | 4221215 | A1 | 1/1994 | |
| DE | 9419014 | U1 | 2/1995 | |
| DE | 102006055463 | B4 | 5/2018 | |
| EP | 3121098 | A2 * | 1/2017 | A45C 13/12 |
| EP | 3170421 | A1 | 5/2017 | |
| EP | 3354154 | A1 | 8/2018 | |
| EP | 4381988 | A1 | 6/2024 | |
| FR | 2789856 | A1 | 8/2000 | |
| JP | 3172052 | U | 11/2011 | |
| JP | 3181838 | U | 1/2013 | |
| JP | 2018158131 | A | 10/2018 | |
| WO | WO-9639891 | A1 * | 12/1966 | A45C 13/20 |
| WO | 9519119 | A1 | 7/1995 | |

* cited by examiner

LUGGAGE ARTICLE ATTACHMENT MEMBER

CROSS REFERENCE TO RELATED APPLICATIONS

This application is a continuation-in-part application of U.S. patent application Ser. No. 17/546,167, filed 9 Dec. 2021, entitled "Luggage Article Attachment Member," which claims the benefit of priority pursuant to 35 U.S.C. § 119 (e) of U.S. provisional patent application No. 63/182,580, filed 30 Apr. 2021, entitled "Luggage Article Attachment Member;" both of which are hereby incorporated by reference herein in their entirety for all purposes. The application is related to U.S. patent application Ser. No. 18/077,150, filed 7 Dec. 2022, entitled "Luggage Article Attachment Member," which is also a continuation-in-part application of U.S. patent application Ser. No. 17/546,167, filed 9 Dec. 2021, entitled "Luggage Article Attachment Member," which claims the benefit of priority pursuant to 35 U.S.C. § 119 (e) of U.S. provisional patent application No. 63/182,580, filed 30 Apr. 2021, entitled "Luggage Article Attachment Member."

BACKGROUND OF THE INVENTION

Travelers frequently travel with many pieces of luggage. Moving with more than one luggage article can be cumbersome. For example when a traveler, especially a lone traveler, has more than one luggage article, the multiple pieces of luggage can be difficult to maneuver through an airport, train or bus station, or on a street. Many current luggage articles lack a feature by which a second luggage article can be selectively attached to a first luggage article to ease such travel burdens. Some current luggage articles include features such as belts or straps, which may be removable or retractable, by which a second luggage article may be selectively attached to a first luggage article. Such solutions are lacking in that they add un-necessary weight, complexity, and/or cost to the luggage article. Furthermore, removable attachment members are prone to being lost or misplaced. Features to enable the selective attachment of a second article to a luggage article, other than retractable attachment members, have not often been added to hard side luggage articles mainly due to the difficulty and expense of adding external features to hard side shell structures.

BRIEF SUMMARY OF THE INVENTION

The present disclosure provides a luggage case. The luggage case includes a main body including a lid shell and a base shell, wherein the lid shell and the base shell are hingedly coupled to one another and selectively closable by a closure mechanism, a primary recess formed on the luggage case, the primary recess defining a bottom wall, a secondary recess formed in the bottom wall of the primary recess, and an attachment member positioned in the secondary recess.

Optionally, in some embodiments, the primary recess may be defined by a bezel, the bezel positioned adjacent an intersection between a top panel and a main panel of one of the shells, a retractable tow handle operably coupled to the luggage case extendable from and retractable into the primary recess, and the secondary recess may be formed in a bottom wall of the bezel.

Optionally, in some embodiments, the attachment member may be below the retractable tow handle when the retractable tow handle is in a retracted position.

Optionally, in some embodiments, the secondary recess may include an upper region having an upper width, and a lower region having a lower width, the lower width being less than the upper width.

Optionally, in some embodiments, the attachment member may include a base portion extending from the secondary recess and an extension portion extending from the base portion in a direction at least partially towards the secondary recess.

Optionally, in some embodiments, a slot may be formed adjacent each opposing side of the base portion.

Optionally, in some embodiments, an auxiliary article may be received in the slots.

Optionally, in some embodiments, the extension portion may be positioned flush with or below the base wall of the primary recess.

Optionally, in some embodiments, the base portion may define a width greater than one third of the lower width.

Optionally, in some embodiments, the base portion may taper along its length.

Optionally, in some embodiments, the attachment member may be configured to engage a portion of an auxiliary article and the secondary recess may be configured to receive the portion of the auxiliary member.

Optionally, in some embodiments, the attachment member and secondary recess may be configured to position a portion of an auxiliary article below the retractable tow handle in a retracted position.

Optionally, in some embodiments, the attachment member and the secondary recess may be configured to position a portion of the auxiliary article at or below the bottom wall of the primary recess.

Optionally, in some embodiments, the attachment member and secondary recess may be configured to receive portions from more than one auxiliary article.

Optionally, in some embodiments, the attachment member and the secondary recess are integrally formed with the bezel.

The present disclosure provides for a luggage case including a main body including a lid shell and a base shell, wherein the lid shell and the base shell are hingedly coupled to one another and selectively closable by a closure mechanism, a primary recess formed on the luggage case, the primary recess including a secondary recess formed in a wall of the primary recess and an attachment member positioned over a portion of the secondary recess, and a retractable tow handle operably coupled to the luggage case extendable from and retractable into the primary recess.

Optionally, in some embodiments, the attachment member may be in contact with or below the retractable tow handle.

Optionally, in some embodiments, the attachment member may include a base portion extending from the secondary recess and an extension portion extending from the base portion in a direction at least partially towards the secondary recess, wherein an outer surface of the extension portion may be at or below a base wall of the primary recess.

Optionally, in some embodiments, the primary recess and secondary recess may be integrally formed in a bezel, the bezel positioned adjacent an intersection between a top panel and a main panel of one of the shells.

Optionally, in some embodiments, slots may be formed adjacent each opposing side of the attachment member and between each opposing side and a wall of the secondary recess.

DETAILED DESCRIPTION OF THE INVENTION

Referring to FIGS. 1-6, an attachment member 200 for a luggage article 100 according to an embodiment is disclosed. Another luggage article 101 may engage the attachment member 200 to be transported along with the luggage article 100. In some examples, the attachment member 200 may include a hook member portion 211 to which the other luggage article 101 or other object attaches.

Figure 1:
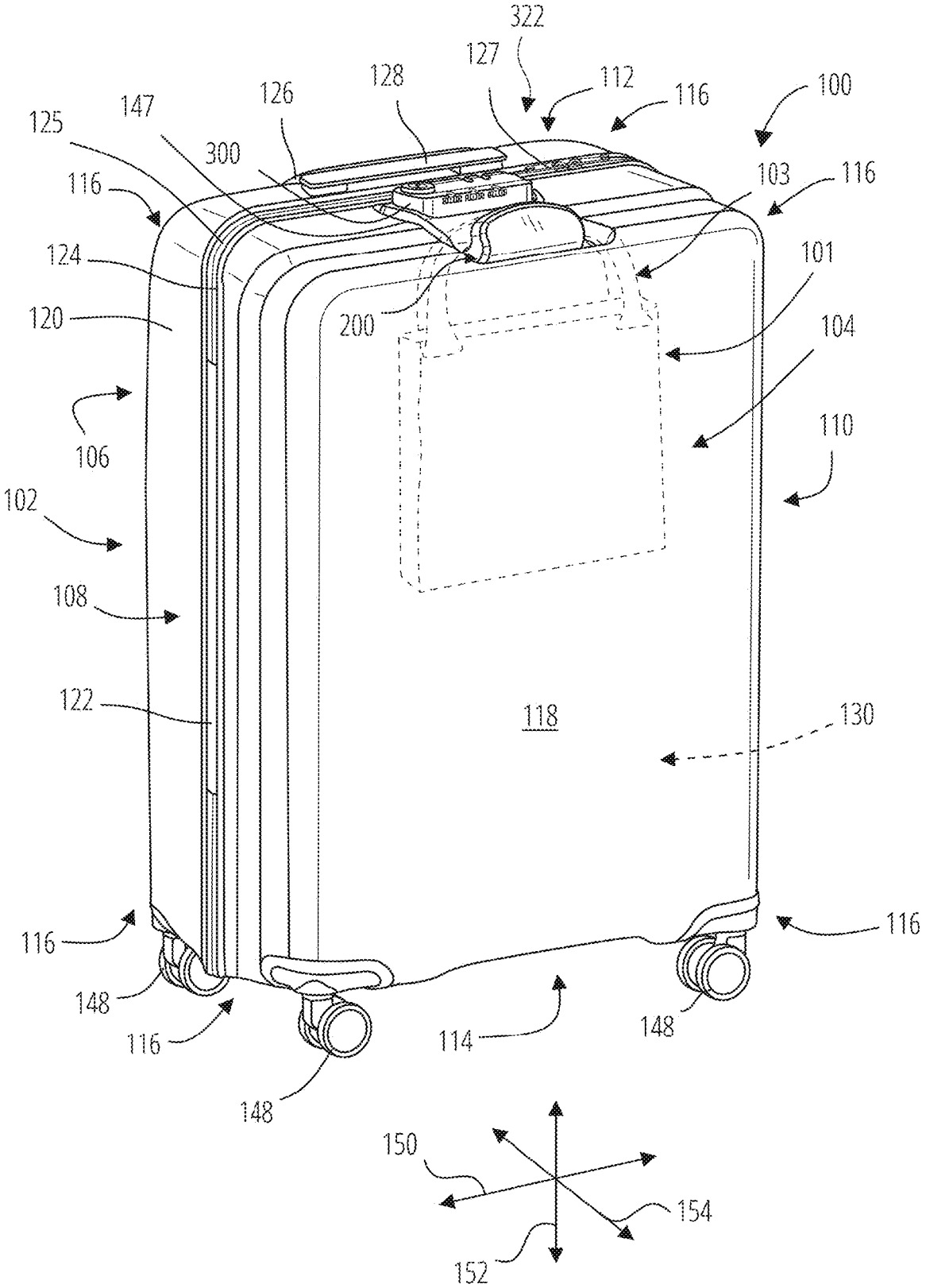
FIG. 1 is an isometric view of a luggage article with an attachment member.

FIG. 1 is an isometric view of a luggage article 100 in a closed configuration, which in some examples may be referred to as a luggage case. The luggage article 100 illustrated in FIG. 1 is an upright hard side case. The luggage article 100 has a main body 102 with a plurality of panels defining an internal storage volume 130 to carry a user's belongings. The luggage article 100 includes a front panel 104 and an opposing rear panel 106, top panel 112 and bottom panel 114, and opposing left panel 108 and right panel 110. Corner regions 116 may be defined by the intersection of any two or three adjacent panels. The luggage article 100 can be moved between a closed configuration in which a lid 118 and a base 120 of the main body 102 are positioned adjacent one another to selectively open or close to provide access to the internal storage volume 130. In some examples, the luggage article 100 may include one or more carry handles 128 and/or a retractable tow handle 126 extendable from a bezel 500 of the rear panel 106 of the luggage article 100. The bezel 500 may be a depression or recess 532 formed on a rear side of the main body of the luggage article 100, for example on the top panel 112 or rear panel 106. The bezel 500 may be formed adjacent an intersection between the top panel 112 and the rear panel 106. The bezel 500 may be defined in part by both the top 112 and rear panels 106 of the suitcase.

The retractable tow handle 126 may extend outwardly from and retract into the bezel 500. The retractable tow handle 126 may include a grip portion 126*a* and one or more telescoping tubes 126*b* extending from the luggage case 100 and connected to the grip portion 126*a*. In one example, two telescoping tubes 126*b* are included. In operation, the telescoping tubes 126*b* may retract to allow the grip portion 126*a* to be received within the bezel 500. The telescoping tubes 126*b* may retract so that the grip portion 126*a* contacts a bottom wall 501 of the bezel 500 or so that the grip portion 126*a* is closely spaced from the bottom wall 501 of the bezel 500. The telescoping tubes 126*b* may also extend to their full length to allow a user to pull or tow the luggage article 100.

The luggage article 100 may include one or more foot elements 148 such as wheels, casters, spinner assemblies, posts, or the like to support or enable the movement of the luggage article 100 on a support surface such as a floor, street, sidewalk, or the ground. The luggage article 100 may be many types of luggage, including a soft side spinner case, a hybrid spinner case, a container, or the like.

Throughout this disclosure, reference may be made to a width or transverse direction 150, a length or vertical direction 152, and/or a depth direction 154. The width or transverse direction 150 is generally a direction between the left panel 108 and the right panel 110. The length or vertical direction 152 is generally a direction between the top panel 112 and the bottom panel 114. The depth direction 154 is generally a direction between the front panel 104 and rear panel 106. The width direction 150, length direction 152, and depth direction 154 may be mutually orthogonal in some examples. These directions are meant to be illustrative only and are in no way limiting.

The luggage article 100 has a recess 132 formed in the main body 102. The luggage article 100 includes an attachment member 200 coupled to the main body 102, and in this example the attachment member 200 is received in the recess 132. The attachment member 200 may be positioned in the recess 132 and coupled to an outer surface of the main body 102 together with a lock mechanism 300. The attachment member 200 may have an overall hook-like shape. In many embodiments, the recess is formed in the lid or the base. In the example, shown in FIG. 1, the recess 132 is formed in the lid 118 and the attachment member 200 is coupled to the lid 118 in the recess 132. In other examples, the attachment member 200 may be coupled to another portion of the main body 102, may be positioned in a recess or not positioned in a recess. As shown in FIG. 1, a second or other luggage article 101, for example a hand bag, engages the attachment member 200 to be suspended along a front panel 104 of the luggage article 100. The second luggage article 101 may include a portion to engage the attachment member 200, such as handles 103. One or more of the handles 103 are seated in and selectively engaged with the attachment member 200 (also see the representative dashed handles 103 in FIG. 5).

The luggage article 100 can be configured in an open position with the lid 118 and the base 120 positioned apart from one another. The lid 118 and the base 120 may be pivotably attached together such as by a hinge 122 or similar mechanism, and may be releasably attached together by a closure mechanism 124 to releasably secure the lid 118 and the base 120 together in the closed configuration. In some examples, the closure mechanism 124 is a zipper 125. The closure mechanism 124 may extend along one or more edges of the lid 118 and the base 120. The closure mechanism 124 may include complementary portions on each of the lid 118 and the base 120, where the complementary portions are selectively couplable or decouplable relative to one another. When the complementary portions of the closure mechanism 124 are coupled, the lid 118 and the base 120 form a closed internal storage volume 130. The closure mechanism 124 may include an actuator such as one or more pull tabs that enable a user to selectively couple or decouple the complementary portions of the closure mechanism 124. In the example of a zipper, the closure mechanism 124 may have one or more pull tab actuators 127 that are slidable along the length of the closure mechanism 124 to selectively couple or decouple the complementary portions of the closure mechanism 124.

The lock mechanism 300 may be operable to thwart, prevent, or discourage the unauthorized opening of the luggage article 100. For example, the lock mechanism 300 may be a zipper lock, and may be operative to receive and secure the pull tab actuators 127 (see FIG. 1) of the zipper 125 example of a closure mechanism 124 to prevent the actuators from being slid along the length of the closure mechanism 124 and thus prevent the opening of the closure mechanism 124. The lock mechanism 300 may, additionally include a key or combination lock 129 such that persons with the key or combination can remove the pull tab actuators from the lock mechanism 300 such as by pushing an actuator 318, which causes the lock mechanism 300 to release the pull tabs.

Figure 4:
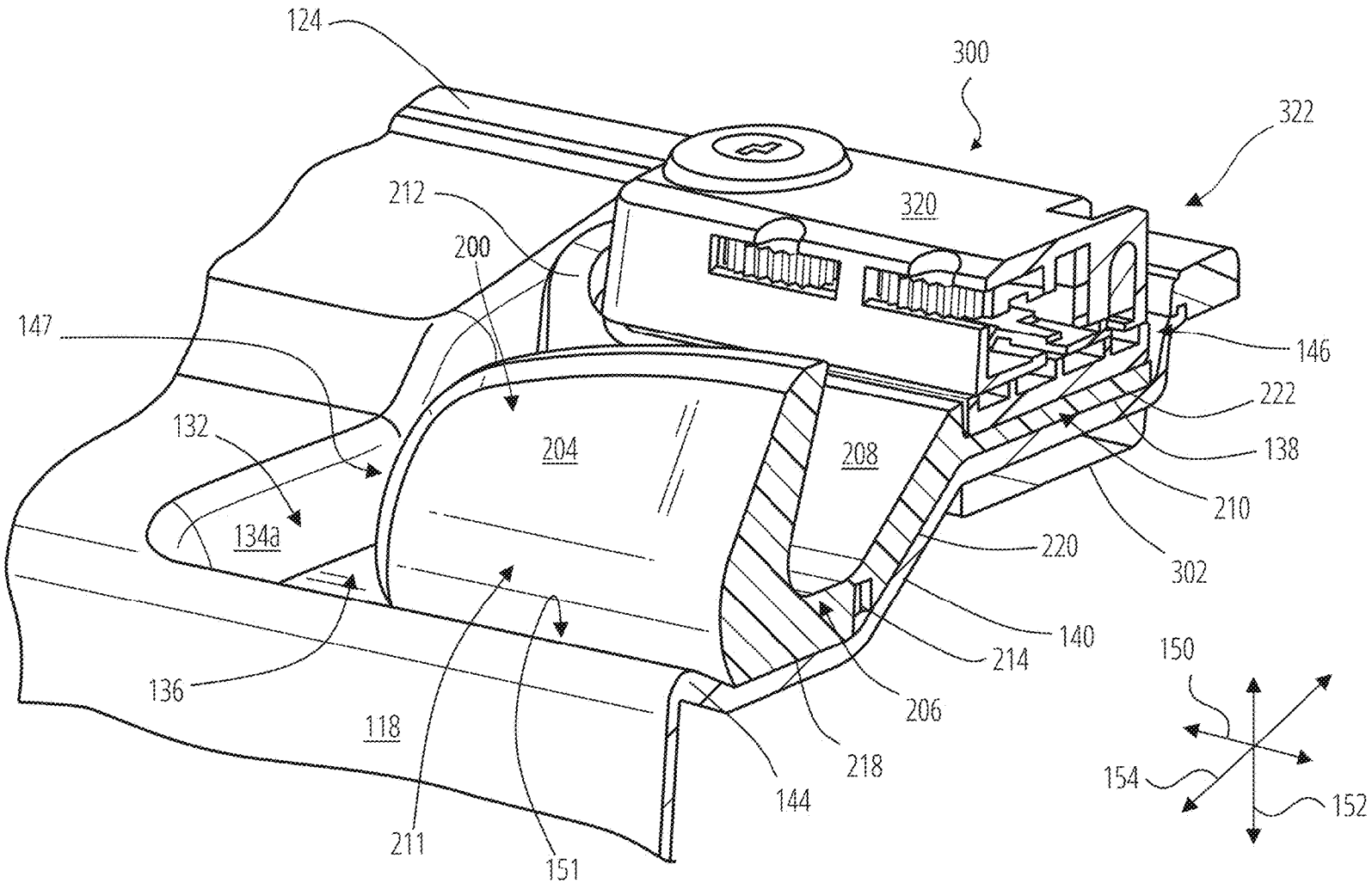
FIG. 4 is a partial section view of the luggage article of FIG. 1 taken along section line 4-4 of FIG. 2.
Figure 5:
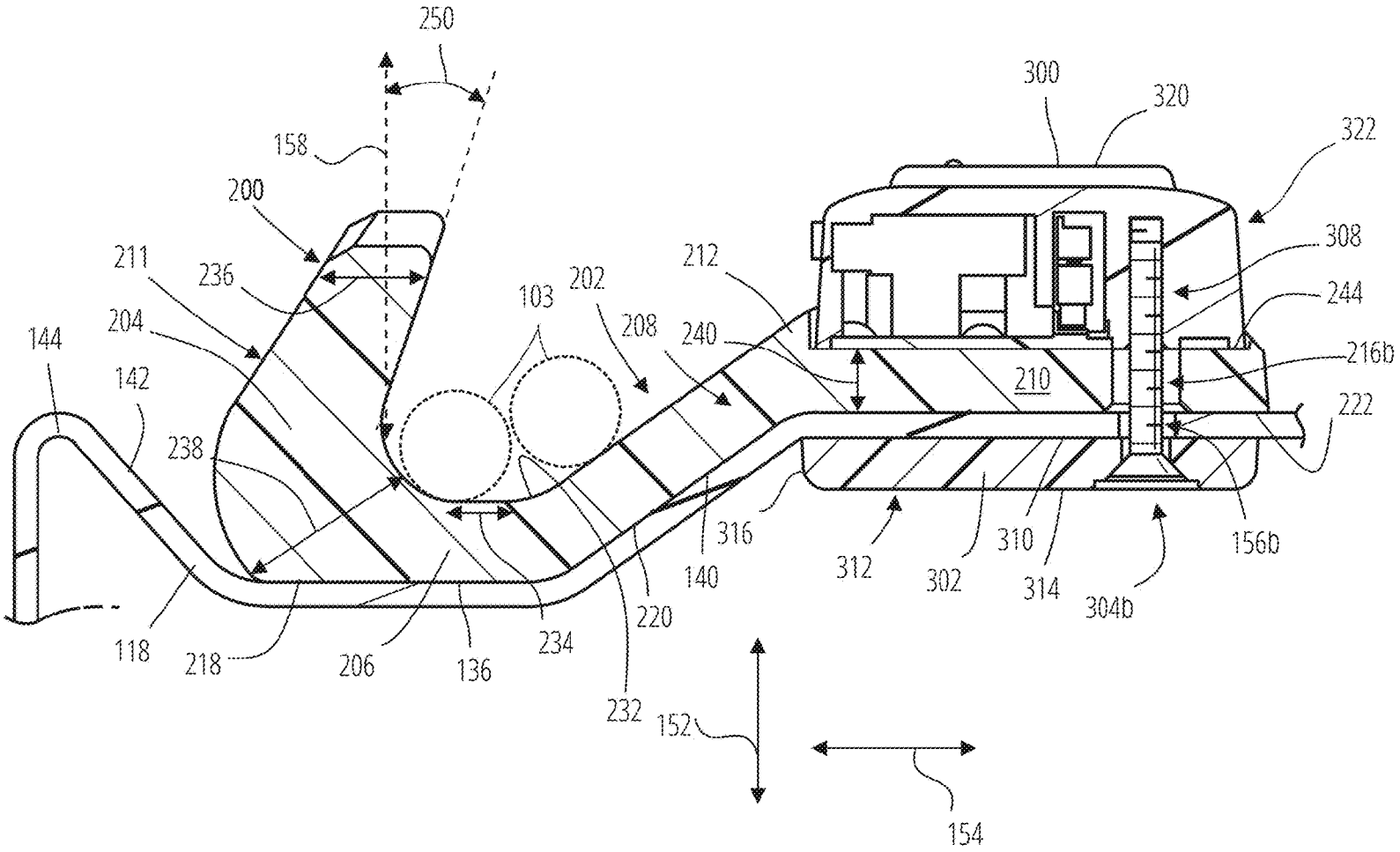
FIG. 5 is a partial section view of the luggage article of FIG. 1 taken along section line 5-5 of FIG. 2.
Figure 6:
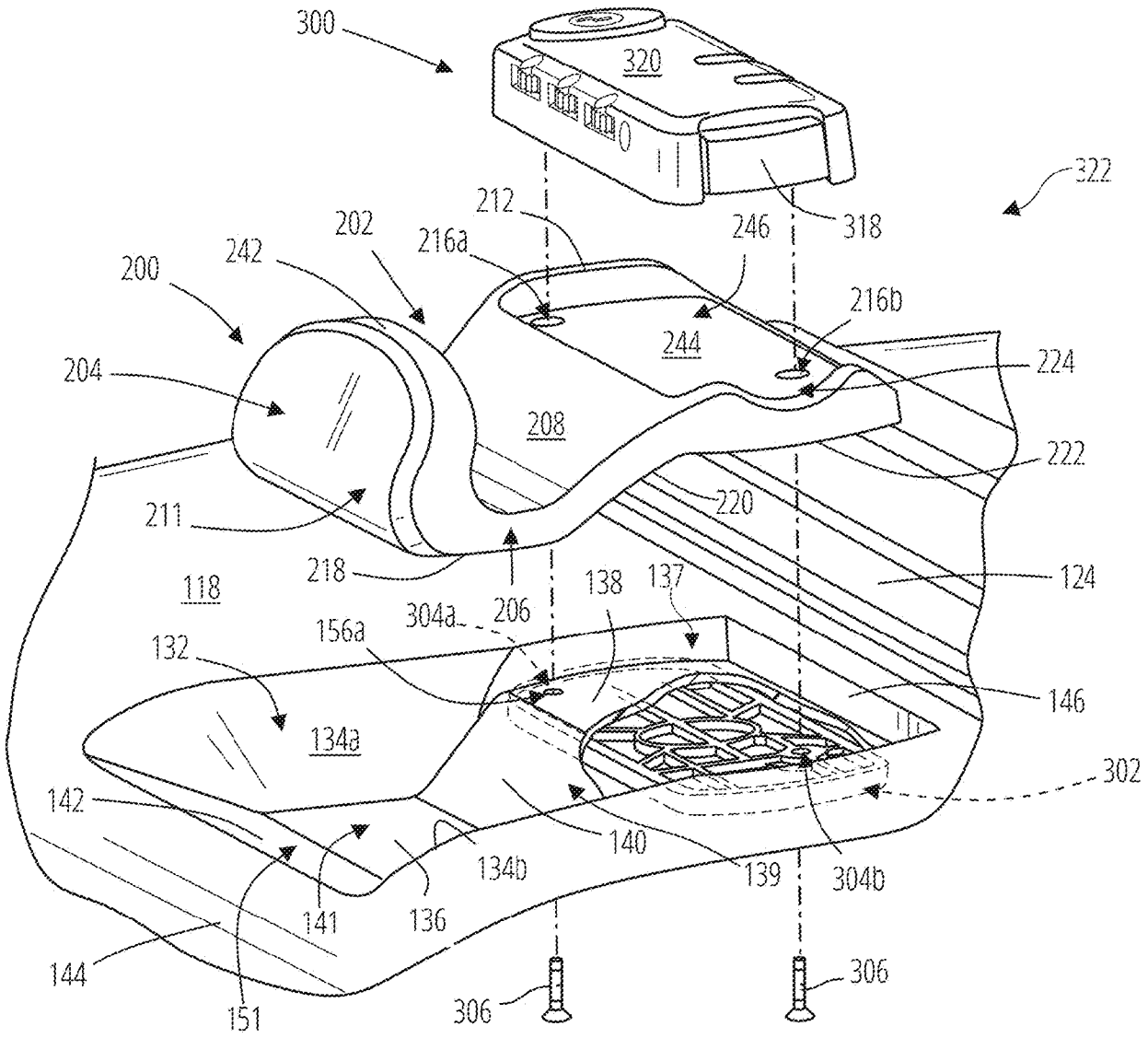
FIG. 6 is a partial exploded isometric view of the luggage article of FIG. 1.

In one embodiment, the lock mechanism 300 is secured to the main body 102 with an anchor element 302. The anchor element 302 is disposed inside the luggage article 100 and the lock mechanism 300 is disposed on the outside of the luggage article 100 with a portion of the main body 102 clamped between the anchor element 302 and the lock mechanism 300. The anchor element 302, in this example, includes a plate 312 with an upper face 310 and an opposing lower face 314. A wall 316 joins the upper face 310 and the lower face 314. The anchor element 302 may be formed of any suitable material such as plastic, metal, a composite material (e.g., a fiber reinforced composite), wood, etc. The anchor element 302 may have one or more apertures 304*a, b* formed therein. The apertures 304*a, b* may be adapted to receive one or more fasteners 306. As best shown in FIG. 4-FIG. 6, the anchor element 302 is disposed on an inner surface of the lid 118. In other embodiments, the anchor element 302 may be disposed on an inner surface of another portion of the main body 102, such as the base 120. As shown in FIG. 5, the lock mechanism 300 may include one or more recesses 308 formed therein that are operative to receive one or more fasteners 306. The recesses 308 and the fasteners 306 may be threaded to engage when the fastener 306 is rotated relative to the recess 308. Other types of fasteners 306 may be used, such as pins, nails, rivets, or the like. The recesses 308 may be blind recesses as shown, or they may be through holes that extend through the lock mechanism 300.

As best shown in FIG. 4-FIG. 6, in one embodiment, the attachment member 200 is coupled to the main body 102 together with the lock mechanism 300 as an assembly 322, positioned in this example on the outside of the main body 102. The anchor element 302 is disposed inside the luggage article 100. The attachment member 200 is disposed on the outside of the luggage article 100. The lock mechanism 300 is disposed on top of, or on the outside of, the attachment member 200. The anchor element 302, a portion of the main body 102 (in the recess 132), the base plate 210 of the attachment member 200, and the lock mechanism 300 are secured together by the fasteners 306. In one example, the fasteners engage with the anchor element 302 and the lock mechanism 300 to clamp the base plate 210 of the attachment member 200 and the portion of the main body 102 there between. An advantage of coupling the attachment member 200 to the luggage article 100 as an assembly with the lock mechanism 300 may be cost savings realized by using the lock mechanism 300 and the anchor element 302 to serve an additional function of securing the attachment member 200 to the luggage article 100. Additionally, joining the attachment member 200, and the lock mechanism 300 together in the assembly 322 may increase the strength and/or rigidity of the combined assembly 322. The lock mechanism 300 as received in the recess on the top of the base is better protected from damage, in part by the rim covering some of the periphery of the lock mechanism.

The recess 132 is formed in the main body 102 of the luggage article 100. The recess 132 is defined by a depression of the main body 102 into the luggage article 100. The recess 132 has a depth, length, and a width suitable to receive at least a portion of the attachment member 200. The attachment member 200 is defined by a body 202 including a base plate 210, a shank 208, an intersecting portion 206, and a tine 204. In some embodiments, the shank 208 extends at an angle from the base plate 210. In some embodiments, the intersecting portion 206 extends at an angle from the shank 208. In some embodiments, the tine 204 extends at an angle from the intersecting portion. In some embodiments, the shank 208, the intersecting portion 206, and the tine 204 transition smoothly between one another such as in one or more curves. In one example, the attachment member 200 may in part include a hook member 211. The main body 202 of the attachment member 200 may in part form the hook member 211. In one example, the hook member 211 may be formed by at least the shank 208, the intersecting portion 206, and the tine 204. In one example, such as that of FIG. 4, the hook member 211 may have a generally curved shape, such as a generally J-shaped curve. The attachment member 200 may thus include the hook member 211 and the base plate 210. In one example, such as shown in FIGS. 1 and 4, attachment member 200 curves away from the luggage article 100. For example, the hook portion 211 of the attachment member 200 may curve away from the luggage article 100, such as for example the tine 204 of hook member 211 may curve upwards and away from the top panel 112 of the luggage article 100.

The base plate 210 includes an upper surface 244 having a rim 212 extending around the upper surface 244 forming a recess. The rim 212 may vary in height in a portion thereof to form a scallop 224 to allow access to the actuator 318 when the luggage article 100 is assembled, such that a user can operate the actuator 318 to disengage the lock mechanism 300. The rim 212 and the recess in the upper surface 244 form a receptacle 246 suitable to receive the lock mechanism 300. The height of the rim 212 may be higher near the front panel 104 than near the rear panel 106 (see, e.g., FIG. 5) to stiffen and/or strengthen the front of the base plate 210 and reduce flexure of the attachment member 200 and/or stabilize the lock mechanism 300 against lateral forces. Additionally, the lower rear portion of the rim 212 may allow for better access to the pull tabs of the closure mechanism 124. As discussed above, the lock mechanism 300, the attachment member 200, and the anchor element 302 may be sandwiched together with a portion of the main body 102 in the assembly 322. On the bottom of the body 202 are, one or more apertures 216*a* that may extend through the body 202 to enable the coupling of the attachment element in the assembly 322. The apertures 216*a* may extend through the upper surface 244 such that the apertures 216*a* are in communication with the receptacle 246 at one end and the lower surface 222 at the other end. The apertures 216*a* may be operative to receive respective fasteners 306 to couple the attachment member 200 to the luggage article 100. The apertures 216*a* and 216*b* may be clearance apertures with a dimension larger than a dimension of the fastener 306.

The body 202 may be formed of any suitable material such as plastic, metal, a composite material (e.g., a fiber reinforced composite), wood, etc. The body 202 may be formed by any suitable method such as vacuum forming, injection molding, subtractive manufacturing (e.g., machining), additive manufacturing (e.g., 3D printing), or the like. The body 202 may be a single unitary piece. The body 202 may be two or more pieces joined to one another such as by a fastener, adhesive, brazing, welding, or the like.

In some embodiments, the base plate 210 has a dimension 240 between the upper surface 244 and the lower surface 222 of about 3-4 mm. In other embodiments, the dimension 240 may be about 1 mm or 2 mm. In other embodiments the dimension 240 may be about 5 mm, 6 mm, 7 mm, 8 mm, 9 mm, 10 mm, or more.

The shank 208 may extend from the base plate 210. The shank 208 may extend generally down into the recess 132 in the top panel 112 of the main body 102. The shank 208 may also extend in the recess 132 from the base plate 210 toward the front panel 104. In one embodiment, the shank 208 extends into the recess 132 at an angle from a plane defined by the top panel 112 (see, e.g., FIG. 5). In some embodiments, a securement recess 214 may be formed in the body 202 such as near an interface of the shank 208 and the intersecting portion 206. The securement recess 214 may be operative to receive a fastener to better secure the attachment member 200 to the luggage article 100. In many embodiments, the securement recess 214 is optional. The shank 208 has a width dimension 248 (see, e.g., FIG. 4). The shank 208 defines an intermediate face 220 on a lower surface thereof. In many embodiments, the intermediate face 220 is a planar surface. In other embodiments, the intermediate face 220 may be a curved or irregularly shaped surface.

The intersecting portion 206 extends from a lower end of the shank 208 opposite the upper end of the shank 208. The intersecting portion 206 is a transition portion between the shank 208 and the tine 204. In one embodiment, the intersecting portion 206 forms a surface 232 on an upper surface thereof. The surface 232 may be a planar surface. The surface 232 may be operative to receive or support an attachment of secondary luggage article such as a strap or handle to selectively attach the secondary luggage article to the primary luggage article 100. In one embodiment, the surface 232 has a length of about 4 mm in the dimension 234. In other embodiments, the length of the dimension 234 may be about 0 mm, 1 mm, 2 mm, 3 mm, 5 mm, 6 mm, 7 mm, 8 mm, 9 mm, 10 mm, or more. In other embodiments, the surface 232 may be a curved or filleted shape with no effective length in the dimension 234.

The tine 204 of the hook shape extends generally upward from the intersecting portion 206. The tine 204 may also extend back toward the rear panel 106 (see, e.g., FIG. 5). In some embodiments, the tine 204 may extend at an angle 250 of about 18° relative to a normal direction 158 of the top panel 112, and in some examples in the direction of a center of the luggage case 100, and in the example shown in the direction of the lock mechanism 300 (See FIG. 3). In some embodiments, the tine 204 may extend at an angle 250 of about 0°, 5°, 10°, 15°, 20°, 25°, 30°, 35°, 40°, 45° or more relative the normal direction 158 of the top panel 112. The tine 204 may also have a width dimension 248 (see, e.g., FIG. 2). The tine 204 has a thickness dimension 238 at a transition between the tine 204 and the intersecting portion 206. In some embodiments, the thickness dimension 238 is about 9.5 mm. In other embodiments the thickness dimension 238 may be about 5 mm, 6 mm, 7 mm, 8 mm, 9 mm, 10 mm, or more. The thickness dimension 238 may be the thickest part of the attachment member 200 such as to counteract bending forces on the tine 204 imparted by attached luggage articles or the like. The tine 204 has a thickness dimension 236 near a tip 242 thereof. In some embodiments, the thickness dimension 236 is about 7 mm. In other embodiments the thickness dimension 236 may be about 1 mm, 2 mm, 3 mm, 4 mm, 5 mm, 6 mm, 7 mm, 8 mm, 9 mm, 10 mm, or more. In some embodiments, the thickness dimension 236 may taper from a central portion of the tine 204 toward the edges of the tine 204 along the width thereof. In some embodiments, the dimension of the tine 204 tapers from the thickness dimension 238 to the thickness dimension 236. For example, the thickness dimension 236 may be less than the thickness dimension 238.

When an additional luggage case is engaged with the attachment member 200, a portion of the additional luggage case, such as a handle, is received by at least a part of the engagement portion of the attachment member formed by a portion of the upper surfaces of the shank 208, a portion of the tine 204, and the intersecting portion 206.

Figure 2A:
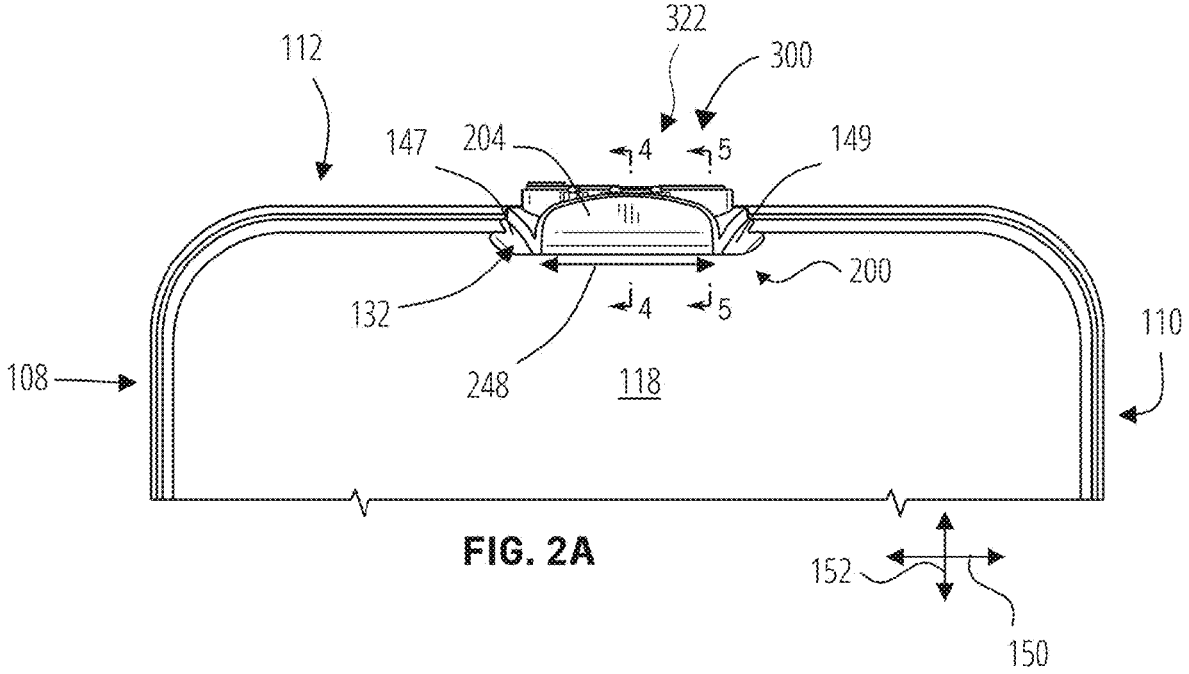
FIG. 2A is a partial front elevation view of the luggage article of FIG. 1, and shows an attachment member.

In some embodiments, the attachment member 200, such as for instance shown in FIG. 2A, has a width dimension 248 of about 70 mm. For example, at least a portion of the shank 208, the intersecting portion 206, and/or the tine 204 may have a width dimension 248 of about 70 mm. In some embodiments, the width dimension 248 of the shank 208, the intersecting portion 206, and/or the tine 204 may be about 10 mm, 20 mm, 30 mm, 40 mm, 50 mm, 60 mm, 70 mm, 80 mm, 90 mm, 100 mm, or more. The width dimension 248 may be generally consistent between the shank 208, the intersecting portion 206, and/or the tine 204.

Figure 2B:
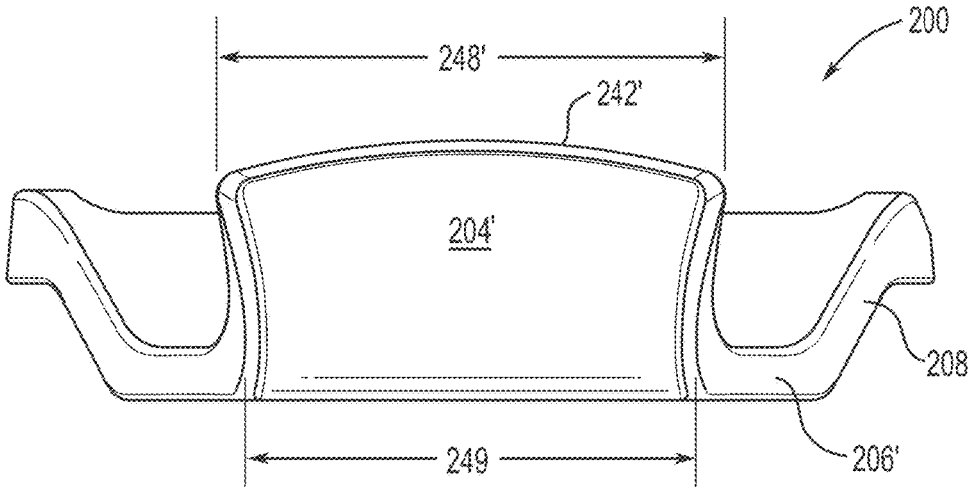
FIG. 2B is a front elevation view of another embodiment of the attachment member.

Alternatively, in another example of the attachment structure 200' as shown in FIG. 2B, the width 248' (in the same or similar width direction as width 248) of the region of the tine 204' near the tip 242' may be wider than the width 249 of the tine 204' at or near its intersection with the intersecting portion 206'. In this example the width dimension 248' of the region of the tine 204' near the tip 242', may be approximately 50 mm, with the tine 204' tapering inwardly as it extends downwardly to a width dimension 249 of approximately 47.5 mm at or near where the tine 204' engages with the intersecting portion 206'. The attachment structure 200', other than the width dimensions as described above, is structurally the same as or is identical to the attachment structure 200 referenced elsewhere herein. A benefit of a relatively wide tine, such as by relatively consistent width dimension 248 or varying width dimensions 248' and 249, may be that the attachment member is strong enough to resist deflection, torsion, deformation, or breakage and may impart less stress on articles coupled to the luggage article 100 via the attachment member relative to a narrower attachment member. Additionally, the width dimension 248 of approximately 70 mm is approximately the width of a typical human hand, which is the basis of the size of many handles on bags that might be coupled with the attachment member 200.

As best shown in FIG. 6, the main body 102 may have a recess 132 formed therein. The recess 132 may be adapted to receive the attachment member 200 and/or the lock mechanism 300. A benefit of the attachment member 200 and/or portion of the lock mechanism 300 being received in the recess 132 may be to reduce the protruding distance of the attachment member 200 above the top panel 112, which is a difficulty with respect to additional features and functionality structures attached to the exterior of hard side luggage. The attachment member 200 and the lock mechanism 300 while received in the recess 132 do not increase the external size of the luggage article 100. Additionally, by being received in the recess 132, at least partially, the attachment member 200 and the lock mechanism 300 may be somewhat protected from damage such as when snagging on, or being impacted by, objects when being handled. Positioning the attachment member 200 and/or the lock mechanism 300 in the recess 132 may result in a luggage article 100 that is more aesthetically pleasing than simply attaching the attachment member 200 and/or lock mechanism 300 to the main body 102. Positioning the attachment member 200 and/or lock mechanism 300 in the recess 132 may form a stronger assembly 322 as the walls of the recess 132 help keep the tine 204 from being displaced laterally. For example, the side walls 134*a, b* may support the attachment member 200 such that lateral or twisting displacement thereof is limited.

In many embodiments the recess 132 is formed in the lid 118. In the present example, the recess 132 is formed in the top panel of the lid 118. In other embodiments, the recess 132 may be formed in another portion of the main body 102 such as the base 120. The recess 132 is formed as an area of off-set depression. The recess may be defined by a periphery, in the current example, by sidewall 134, and a floor portion 135. The side wall 134 may extend at a right angle from the floor 135, or may extend at an angle other than a right angle from floor 135. The recess has at least one depth, at least one width (e.g. as measured between side walls 134*a* and 134*b*), and at least one length (e.g. as measured by between the front wall 142 and the rear wall 146). The recess 132 may have one or more sub-portions such that when combined together form the entire recess 132. The depth, width and length of any sub-portions of the recess may be the same or different than another sub-portion. Generally, the width of the recess 132 between walls 134*a* and 134*b*, and the length of the recess between the front wall 142 and rear wall 146 are sufficiently sized to receive the attachment member 200, as described further below. In one example, the width of the recess between side walls 134*a* and 134*b* is greater than the width of the attachment member 200. The difference in width dimensions may form a gap 147, 149 between either side of the hook member 211 and the respective side wall 134*a* and/or 134*b*. In one example, the width between the walls 134*a* and 134*b* may be about 115 mm.

In some embodiments, the recess 132 includes a first sub-portion 137 defined by upper floor 138, side walls 134*a* and 134*b*, and a rear wall 146. The upper floor 138 may be at a depth of approximately 6-7 mm. In some embodiments, the upper floor 138 extends generally in a plane oriented similarly to (such as example being parallel to) the panel in which the recess 132 is formed. One or more apertures 156*a* and 156*b* may be formed in the upper floor 138. The apertures 156*a* and 156*b* may be operative to receive one or more respective fasteners 306. The apertures 156*a* and 156*b* may be clearance apertures with a dimension larger than the respective fastener 306.

In some embodiments, the recess 132 includes a second sub-portion 139 defined by an intermediate floor 140. The intermediate floor 140 may extend from the first sub-portion to a third sub-portion. Because the third sub-portion has a greater depth than the first sub-portion, the intermediate floor may have an increase depth as it angles downwardly from the first sub-portion to the third sub-portion 141, forming a ramp between the first and second sub-portions. The intermediate floor 140 in this example may be at a depth of approximately 6-7 mm where it intersects the first sub-portion 137, and at a depth of approximately 18-19 mm where it intersects the third sub-portion. In this example, the intermediate floor 140 extends at an angle relative to the first sub-portion and the third sub-portion. As discussed further herein, the ramp or slope of the intermediate floor may support a part of the attachment member 200, such as the shank 208.

In some embodiments, a third sub-portion 141 of the recess 132 may extend towards the front panel 104, and in some examples may extend sufficiently far so as to overlap with the front panel 104. The recess may include a lower floor 136, and a front wall 142 that extends between the side wall 134*a* and the side wall 134*b* proximal to, at or overlapping the front panel 104. The lower floor 136 may be at a depth of approximately 18-19 mm. The front wall 142 may be included in a lip portion 144 of the main body 102, for example the front wall 142 may be formed by a lip portion. In some embodiments, the front wall 142 extends at an angle relative to the lower floor 136. For example, the front wall 142 may form a sloped surface that provides a smooth transition from the lower floor 136 to the panel in which the recess 132 is defined. In other embodiments, the front wall 142 may extend generally at right angles to the lower floor 136. A gap 151 may be formed between the attachment member 200 and the front wall 142. For example, the gap 151 may be formed between an end of the hook member 211 and the front wall 142. This gap may be continuous with the gaps 147, 149 on opposing sides of the attachment member 200 when in the recess 132. In one embodiment the recess 132 does not include a front wall 142, and the attachment member 200 (for example the hook member 211) may not have be enclosed at or near the front panel 104.

In some embodiments, the recess 132 includes a rear wall 146 extending between the side wall 134*a* and the side wall 134*b* opposite the front wall 142. In some embodiments, the rear wall 146 extends generally at a right angle from the adjacent upper floor 138.

As best shown in FIG. 4 and FIG. 5, in some embodiments, when the luggage article 100 is assembled, the attachment member 200 may be received in the recess 132. The lower surface 222 may be disposed on the upper floor 138. As best shown in FIG. 5 and FIG. 6, in some embodiments, the anchor element 302 may be disposed on an interior surface of the main body 102 below the upper floor 138 of the recess 132. The lock mechanism 300 may be disposed above the attachment member 200. The lock mechanism 300 may be received in the receptacle 246. One or more fasteners 306 may be inserted through the one or more respective apertures 304*a* and 304*b*. The one or more fasteners 306 may be inserted through the respective aperture 156*a* and 156*b*. The fasteners 306 may be inserted through the one or more apertures 216*a* and 216*b*. The fasteners 306 may be inserted into the one or more recesses 308. In some embodiments, the fasteners 306 may include helical threads such that when the fasteners 306 are rotated relative to the recesses 308, the respective threads of the fasteners 306 and the recesses 308 engage to secure the attachment member 200 to the luggage article 100 between the anchor element 302 and the lock mechanism 300. In other embodiments, such as when the fasteners 306 are rivets, the head of the rivet may be inserted through the apertures as described above and the rivet expanded to secure the attachment member 200 to the luggage article 100 via the lock mechanism 300 and the anchor element 302.

When installed with the luggage article 100, the lower face 218 may be disposed on the lower floor 136. In some embodiments, the lower face 218 rests on the lower floor 136 but is not coupled thereto. In some embodiments, the lower face 218 is coupled to the lower floor 136. In some embodiments, the intermediate face 220 may be disposed on the intermediate floor 140. In some embodiments, the intermediate face 220 rests on the intermediate floor 140 but is not coupled thereto. In some embodiments, the intermediate face 220 is coupled to the intermediate floor 140. In some embodiments, the shank 208 and/or the intersecting portion 206 is coupled to one or more of the lower floor 136 or the intermediate floor 140 such as with an appropriate fastener received in the securement recess 214. The tine 204 may be spaced apart from the front wall 142. A benefit of not coupling the shank 208, the intersecting portion 206, and/or the tine 204 to the main body 102 may be that the attachment member 200 forms a cantilever structure. A cantilever structure may flex such as when it becomes snagged on an object during handling. The flexure of the attachment member 200 may enable the attachment member 200 to be released from the object without breaking.

As shown in FIG. 5, a portion 103 of a second luggage article 101, such as one or more handles, may engage the attachment member 200. In some examples, the portion 103 may be seated in the attachment member 200, and may engage a portion of the shank 208, a portion of the intersecting portion 206, and/or a portion of the tine 204 in order to remain removably secured to the attachment member 200. The portion of the attachment member 200 on which the second luggage article 101 is received may have a width dimension of approximately 70 mm as noted above. This width dimension may be a suitable size because many handle structures of luggage articles adapted for carrying by hand have a grip portion of approximately 70 mm. Additionally, a width dimension of approximately 70 mm provides a sufficiently wide and stable contact for a loop handle of the second luggage case to reduce the lateral side to side movement of the second luggage article 101 suspended from the engagement member 200 as the primary luggage article 100 is pulled or moved along a support surface.

Figure 3:
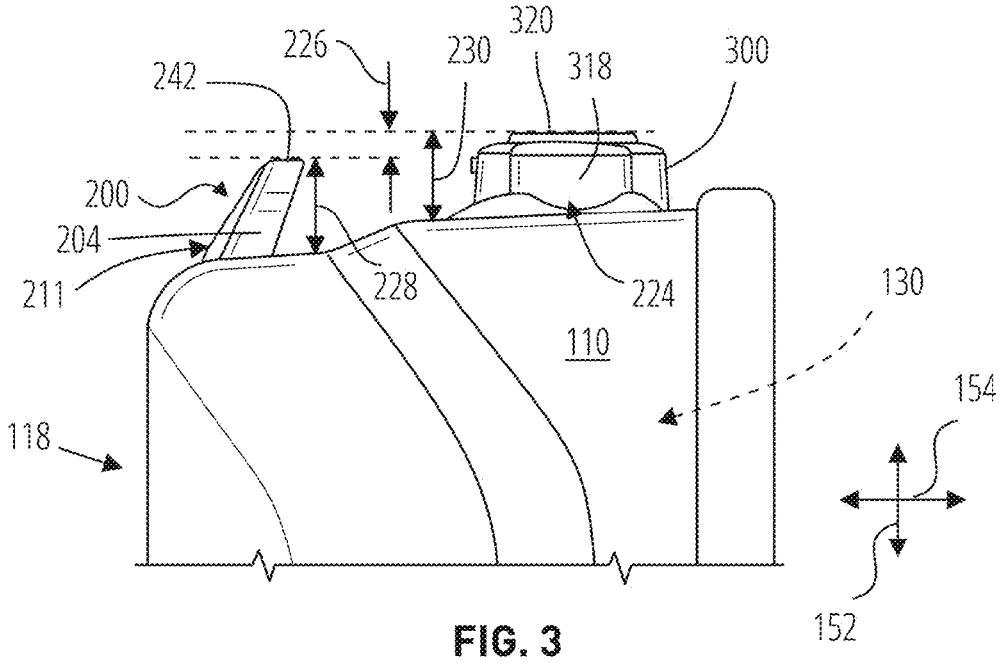
FIG. 3 is a partial right elevation view of the luggage article of FIG. 1.

As best shown in FIG. 3, when the attachment member 200 is installed with the luggage article 100, the tip 242 of the tine 204 may be disposed a relief 228 distance above the main body 102 of the luggage. For example, the tip 242 may rise above the top panel 112 by a relief 228. Similarly, the upper surface 320 of the lock mechanism 300 may be disposed a relief 230 above the main body 102. For example, the upper surface 320 may be disposed above the top panel 112 by a relief 228. The relief 228 may be less than or equal to the upper surface 320, such that the tip 242 is disposed a clearance 226 below the upper surface 320. Such an arrangement may have the benefit of reducing the likelihood of the tine 204 to snag on objects as the luggage article 100 is moved. Reducing the likelihood of snagging may enable the luggage article 100 to be moved more easily (e.g., through luggage handling systems) and may reduce the risk of breakage of the attachment member 200. The tip 242 of the tine 204 may also be disposed at or below an upper surface of the carry handle 128.

In another example of the luggage article 100, as shown in FIGS. 7A-9, an attachment member in the form of attachment member 700 for supporting an auxiliary article 101 may be defined on or by the bezel 500 and configured for placement beneath the retractable tow handle 126. The luggage article 100 may be the same or similar to the luggage article 100 previously described and may include all or some of the same features. For example, the luggage case may have a main body 102 with top 112, bottom 114, front 104, rear 106, left 108, and right 110 panels. The attachment member 700 may allow auxiliary articles 101 to be hung from or supported by the luggage article 100.

Figure 7A:
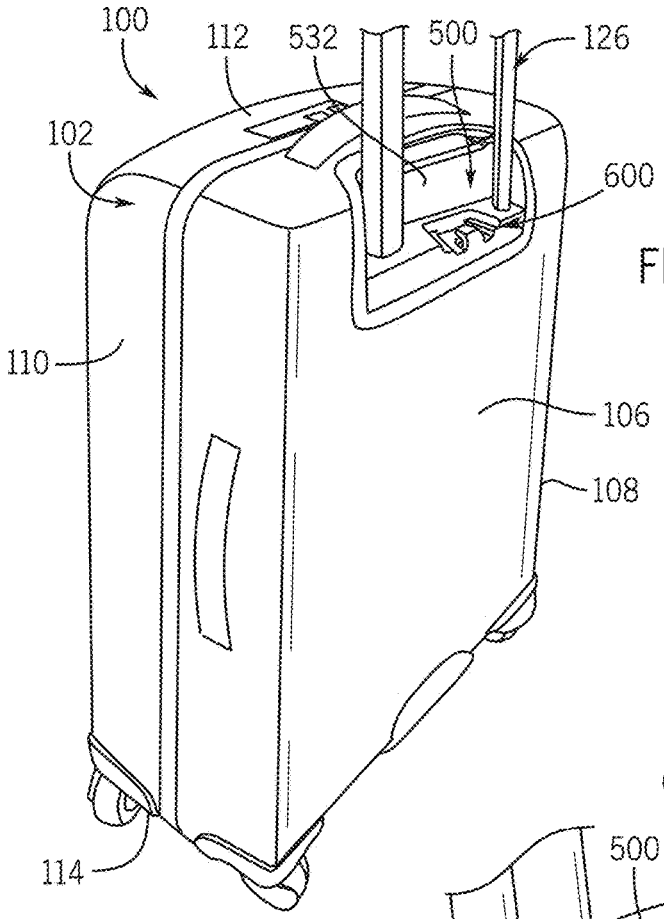
FIG. 7A is an isometric view of a luggage article with an example attachment member.
Figure 7B:
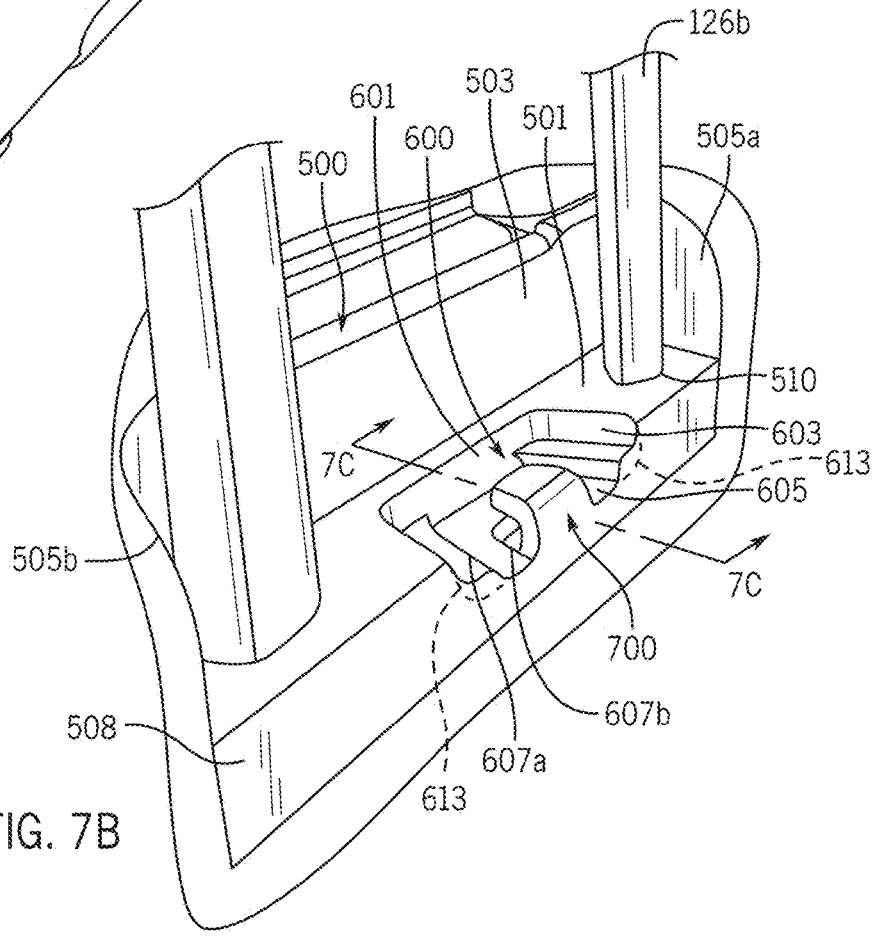
FIG. 7B shows a close up rear right perspective view of the example attachment member of FIG. 7A.
Figure 7C:
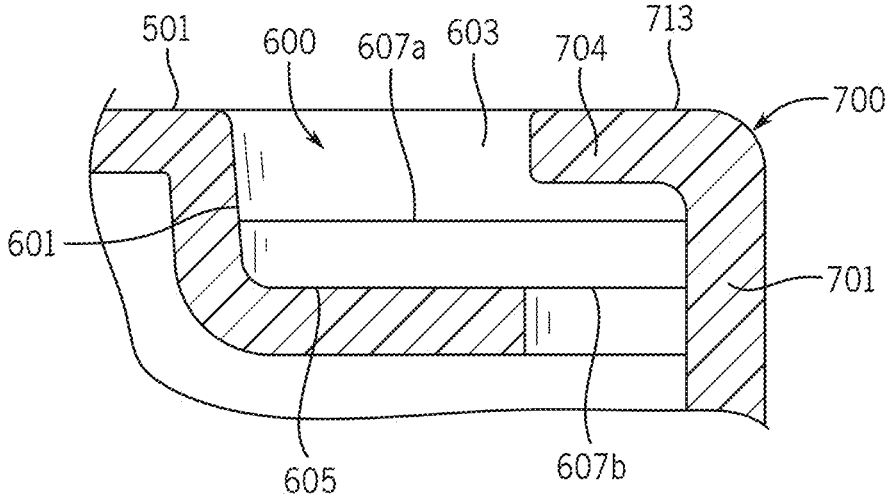
FIG. 7C shows a right cross sectional elevation view of the example attachment member.

As shown in FIGS. 7A-7C, the luggage case 100 may define a primary recess 532 in the shape of a depression in the main body 102, for example in the base shell 120 of case 100. The primary recess 532 may in one example be defined in whole or in part by a bezel 500. A secondary recess 600 may be defined by the bezel 500 for receiving a portion 103 of the auxiliary article 101. An attachment member, such as in one example the attachment member 700, may be positioned in the bezel, such as in one example on a bottom wall 501. In one example, the attachment member 700 may be positioned in a secondary recess 600 formed in the bottom wall 501 of the bezel 500. The attachment member 700 may act to receive and retain a portion 503 of an auxiliary article 101, such as a strap of a purse or hand bag. The attachment member 700 may include a first base portion 701 and a second extension portion 704. The base portion 701 may extend upwardly from the floor wall 605 of the secondary recess 600, and the extension portion 704 may extend towards the secondary recess, and in one example it may extend at an angle from the base portion 701 to overly the floor wall 605 of the secondary recess 600. The outer surface 713 of the extension portion 704 of the attachment member may be positioned at or below the level of the base wall of the primary recess 532, which may be the bottom wall 501 of the bezel 500. As a result, the attachment member 700 of the attachment member may be positioned below the retractable handle so as to not interfere with the grip portion **126*a* of the retractable tow handle 126 when the retractable tow handle 126 is in the retracted position with the grip portion 126*a* stored in the bezel 500**.

The primary recess 532 may be formed in a bezel 500 positioned at the intersection of the top panel 112 and the rear panel 106. The bezel 500 may be integral with the panels, for example as a molded feature of the luggage article 100, or may be one or more separate pieces inserted into an underlying recess of the luggage case 100. The underlying recess may be the primary recess 532, which may be defined by the panels of the luggage case 100. For example, the bezel 500 may overlay a depression or opening defined by the luggage case 100. In other examples, the bezel 500 may only partially define the primary recess 532 and cover a portion of a depression or opening defined by the luggage case 100. In additional examples, a first part of the bezel 500 may cover or define a first section of the primary recess 532 while an additional portion may cover an additional section of the primary recess 532. The bezel 500 may include a main wall 503, a pair of opposing walls such as a left **505*a* and right sidewall 505*b*, and a bottom wall 501. The bezel 500 may further define an exterior wall 508 positioned between the bottom wall 501 and the rear panel 106 of the luggage article 100. The main wall 503 may extend upward from the bottom wall 501. The left and right sidewalls 505 may extend upward from the bottom wall 501 and be located to the opposing lateral ends of the main wall 503. Each of the main wall 503 and sidewalls 505 may be perpendicular to or at an angle to the bottom wall 501. The sidewalls 505 and the main wall 503 may be at an angle to each other or may have a smooth or curved transition. The bottom wall 501 may further define one or more apertures, such as tow handle apertures 510, for the retractable tow handle 126 to extend from the bezel 500 and attach within the primary recess 532**.

As shown in FIG. 7A-7C, the bottom wall 501 of the bezel 500 may define an attachment member 700. In some examples, the attachment member 700 may be positioned in a secondary recess 600 formed in the bottom wall 501 of the bezel 500. The attachment member 700 may be integrally formed in the bezel 500, or may be a separate portion attached to the bottom wall 501 of the bezel 500. The attachment member 700 may be positioned in or over the secondary recess 600.

The secondary recess 600 may be formed in the bottom wall 501 of the bezel 500. The secondary recess 600 may have an opening in more than one direction. For example, the secondary recess 600 may extend to an exterior of the luggage case 100, such as the exterior wall 508, opening outwardly in a direction away from the rear main wall 503. The opening in the exterior wall 508 may define one or more slots or grooves 720. The secondary recess 600 may be a volume where portions 103 of an auxiliary article 101, such as a strap of a bag 103, may be inserted so as to not interfere with the tow handle 126 in a retracted position. The secondary recess 600 may be located in a central area of the bottom wall 501, or in other examples the secondary recess 600 may be positioned closer to one of the main wall 503 or sidewalls 505. The secondary recess 600 may have a rear wall 601 and left 603*a* and right 603*b* opposing end walls 603, and a floor wall 605. The rear wall 601 may be aligned in direction with the main wall 503.

Figure 9:
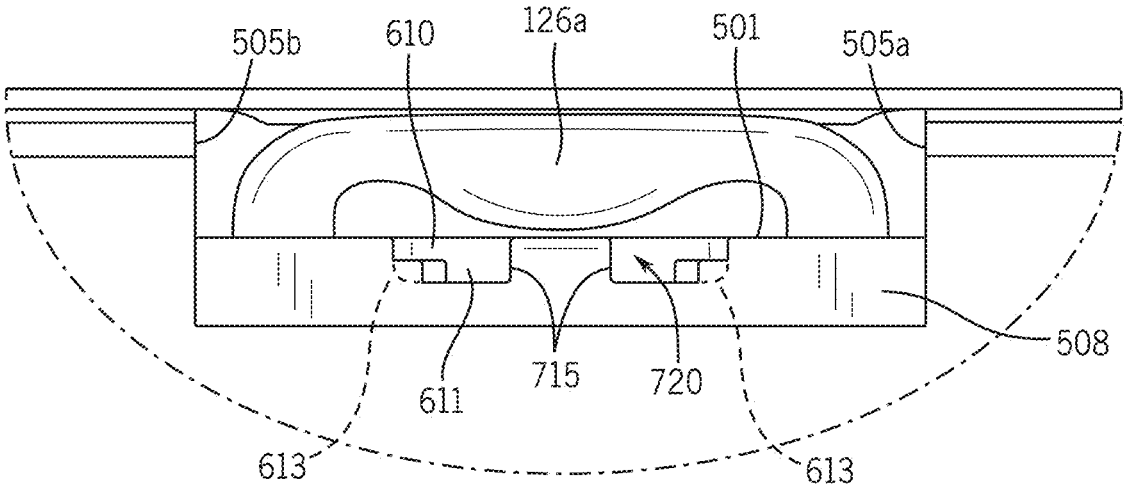
FIG. 9 shows a close up rear elevation view of the attachment member with a retractable tow handle.

Referring to FIGS. 7B and 9, laterally spaced step features 607 may or may not be formed between the floor wall 605 and the side wall 603. The step features 607 may be defined at the intersection of the floor walls 605 and each opposing end wall 603. There may be multiple step features, for example a first step feature 607*a*, a second step feature 607*b* (which in the example shown is the floor 605), and so on. In other examples, there may be only a single step feature, such as 607*a*. The step features 607 may demarcate the secondary recess 600 into an upper region 610 and a lower region 611, where the upper region 610 is wider than the lower region 611, as best shown in FIG. 9. The upper region 610 and lower region 611 may define portions of the slots 720. The step features 607 may act to engage the portion of the auxiliary article 101, and retain it in the secondary recess 600, or to assist in conforming the portion 103 of the auxiliary article 101 to fit snugly within the secondary recess 600. For example, the step features 607 may align the portion of the auxiliary article 101 to curve around or under the attachment member 700. If the auxiliary article 101 has more than one portion 103 to be retained by the step features 607, a first auxiliary portion may be retained in the lower region 611 and a second auxiliary portion may be retained in the upper region 610.

As shown in FIG. 7B and FIG. 9, the end walls may optionally define smooth walls 613. The smooth walls 613 may extend from the bottom wall 501 to the floor walls 605. The smooth walls 613 may have a rectilinear, rounded or concave shape. A secondary recess 600 formed with a smooth wall 613 may define wider slots 720 than when step 607 *b* is present. The wider slots 720 may assist in guiding a portion 103 of a secondary article 101 into engagement with the attachment member 700, and may accommodate handles 103 with larger structure. The smooth walls 613 may also effectuate a curve on the portion 103 of the secondary article 101 and align the portion 103 around the attachment member 700 and through the grooves 720. In some examples, a secondary recess 600 may have a smooth wall 613 with a slope such that an upper width dimension of the recess 600 is greater than a lower width dimension of the recess 600. In such an example, the upper width may define an upper region 610 having the upper width dimension and a lower region 611 having the lower width dimension. The upper width dimension may be greater than the lower width dimension. In other examples, the smooth wall 613 may define a single region with the same or similar width dimension along its height.

The attachment member 700 may be positioned in or adjacent the secondary recess 600. The attachment member 700 may support or retain at least part of an auxiliary article 101 on the luggage case 100, and in some examples within the recess 532 formed by the bezel 500, and in still other examples in the secondary recess 600. The attachment member 700 may include a first portion, or base portion 701, and a second portion, or extension portion 704, and define an outer surface 713, inner surface 710, and opposing edges 715. The base portion 701 may extend upwardly from the floor wall 605 of the secondary recess 600, and may be centrally located to define adjacent slots or grooves 720 between the base portion 701 and the end walls 603. The slots or grooves 720 may receive a portion 103 of the auxiliary article 101 supported from the attachment member 700. The base portion 701 may be straight, curved, or a combination of shapes. In additional examples, the base portion 701 may be angled relative to the floor wall 605, such as in one example being angled inwardly towards the main wall 503 of the secondary recess 600. Being angled inwardly may aid in retaining the portion 103 of the auxiliary article 101 engaged with the attachment member 700. The base portion may define a width between its opposing edges 715 that is approximately equal to or greater than one-third of the width of the lower portion of the secondary recess 600. The width of the base portion 701 may be approximately equal to or less than one-quarter of the width of the upper region 610 of the secondary recess 600. The base portion 701 may also define a width that is constant along its height, or in another example, it may taper from wider to narrow as along its height.

The second, or extension, portion 704 of the attachment member 700 may extend away from the base portion 701 and over the secondary recess 600 toward the main wall 503 of the secondary recess 600. For example, the extension portion 704 may extend from and be angled relative to the base portion 701, and in some examples may extend at an acute angle, right angle, or obtuse angle relative to the base portion 701. The extension portion 704 may be straight, curved, or a combination of shapes. In one example, the base portion 701 and extension portion 704 may together define an inverted J-shaped hook. In such an example, the base portion 701 may be a shank and the extension portion 704 may be a tine of the hook. In another example, the upper 701 and extension 704 portions may together form a curve, such as in one example a constant curve. The opposing edges 715 of the extension portion 704 may define a width, and the width may change as the extension portion 704 extends from the intersection with the base portion 701 to its terminal end, such as in one example tapering to a narrower width. In other examples, the extension portion 704 may have a constant width. The outer surface 713 of the extension portion 704 may be the highest point or region of the attachment member 700. The outer surface 713 may be flush with, or below the bottom wall 501 of the primary recess 532, and not interfere with the handle of the retractable tow handle 126 when in the retracted position. In other examples, the outer surface 713 may extend above the bottom wall 501 in luggage cases where the grip portion 126*a* of the retractable tow handle 126, in the retracted position, is spaced from the bottom wall 501 over the secondary recess 600.

The attachment member 700 may allow a user to store one or multiple auxiliary articles 101 on the luggage article 100 and reduce the number of items that must be carried. Further, when the attachment member 700 supports an auxiliary article 101 and the retractable tow handle 126 is in a retracted position, the attachment member 700 and the tow handle may inhibit or make difficult the removal of the auxiliary article 101.

Figure 8:
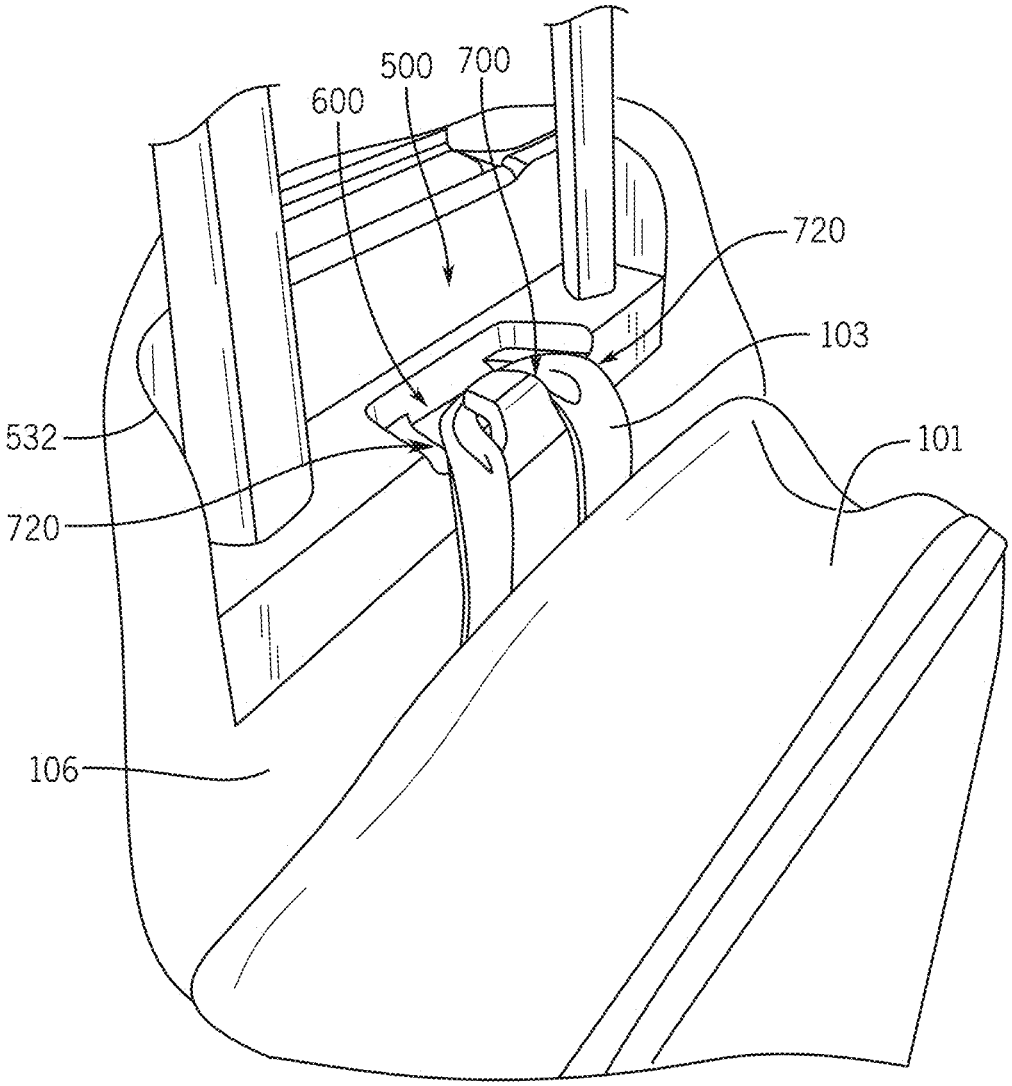
FIG. 8 shows a close up rear right perspective view of an auxiliary article retained by the example attachment member.

As shown in FIG. 8, an auxiliary article 101 may be supported and retained by the attachment member 700. In this example, the portion 103 of the auxiliary article 101 may be a flexible grip handle of a purse, bag, or soft briefcase. In operation, a portion 103 of the auxiliary article 101, such as the handle, may be placed in the lower region 611 of the secondary recess 600, and engaged with the inner surface 710 of the attachment member 700. The portion 103 of the auxiliary article 101 may engage the base portion 701 and extend through the lateral slots or grooves 720 formed adjacent each opposing side of the base portion 701. In one example, the portion extending through the slot 720 may be engaged on opposite sides by an edge of the base portion 701, and the adjacent step feature 607. This may effectuate curvature on the portion 103 of the auxiliary article 101, which may enhance the retention of the article 101 by the attachment member 700. In other examples, the smooth walls 613 may also effectuate a curvature on the portion 103 so that the article 101 is positioned in the slots 720 formed on either side of the attachment member 700. The article 101 may also be in engagement with the attachment member 700. The portion 103 of the auxiliary article 101 may also be positioned underneath the extension portion 704 of the attachment member 700, and may or may not engage the inner surface 710 of the extension portion 704.

In other examples, and as shown in FIG. 9, the attachment member 700 may receive more than one portion 103 of an auxiliary article 101, such as both handles of a purse, bag or soft brief case. In still other examples, the attachment member 700 may receive more than one auxiliary article 101, such as two different purses, bags or soft briefcases. In these examples, one portion may be in the lower portion of the secondary recess 600, and the other portion may be received in the upper region 610 of the secondary recess 600. In this way, the more than one portion may be stacked in the attachment member 700 for support and securement to the luggage case 100.

Continuing with FIG. 9, the retractable tow handle 126 may be collapsed to a retracted position. In the retracted position, the grip portion 126*a* may be closely spaced from, or in engagement with the base wall 501 of the primary recess 532. In this instance, the attachment member 700 may not contact the grip portion 126*a* of the retractable tow handle 126 because the outer surface 713 of the extension portion 704 may be flush with or below flush with the bottom or base wall 501 of the primary recess 532. Because the portion 103 of the auxiliary article 101 may be within the secondary recess 600 and beneath the extension portion 704 of the attachment member 700, the portion 103 may be entirely below the tow handle 126 in the retracted position. Further, the entire auxiliary article 101 may be beneath the tow handle 126 in the retracted position. This configuration may allow for the retractable tow handle 126 to utilize its full retraction and extension capabilities while allowing portions 103 of the auxiliary article 101 to remain in, and be retained by, the attachment member 700 even when the tow handle 126 is retracted.

Where the attachment member 700 is positioned in the bezel 500, the bezel 500 and attachment member 700 may be formed of any suitable materials such as plastic, metal, a composite material (e.g., a fiber reinforced composite), wood, or combinations thereof. The bezel 500 and attachment member 700 may be formed by any suitable method such as vacuum forming, injection molding, subtractive manufacturing (e.g., machining), additive manufacturing (e.g., 3D printing), or the like. A relatively rigid material may be beneficial to support heavier loads in the attachment member 700, although softer material may be suitable. The attachment member 700 may be a single unitary piece or may be two or more pieces joined to one another such as by a fastener, adhesive, brazing, welding, or the like. Further, the exact orientations and angles of the attachment member 700 may be adjusted to accommodate different injection molding techniques. For example, the second step feature 607*b* of the secondary recess 600 may be arranged for a mold to form the inner surface 710 of the extension portion 704 or the attachment member 700.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention. The main body 102 of the luggage case may include one or more layers of material used in the manufacture of hard sided luggage cases. Reference herein to attaching or coupling to the interior or exterior surfaces of the lid 118 and/or base 120 includes attaching or coupling to the any one, or more than one, of the one or more layers of hard sided material forming the main body.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A luggage case comprising:

a main body including a lid shell and a base shell, wherein the lid shell and the base shell are hingedly coupled to one another and selectively closable by a closure mechanism;

a primary recess formed on the luggage case, the primary recess defining a wall, a secondary recess formed in the wall of the primary recess; and an attachment member positioned in the secondary recess, the attachment member comprising a base portion extending from the secondary recess, wherein the attachment member is configured to engage a portion of an auxiliary article and the secondary recess is configured to receive the portion of the auxiliary article.

2. The luggage case of claim 1, wherein:

the primary recess is defined by a bezel, the bezel is positioned adjacent an intersection between a top panel and a main panel of one of the shells;

a retractable tow handle operably coupled to the luggage case extendable from and retractable into the primary recess; and the secondary recess is formed in a wall of the bezel.

3. The luggage case of claim 2, wherein the attachment member is below the retractable tow handle when the retractable tow handle is in a retracted position.

4. The luggage case of claim 3, wherein the attachment member and secondary recess are configured to position a portion of an auxiliary article below the retractable tow handle in a retracted position.

5. The luggage case of claim 2, wherein the attachment member and the secondary recess are integrally formed with the bezel.

6. The luggage case of claim 1, wherein:

the secondary recess includes an upper region having an upper width, and a lower region having a lower width, the lower width being less than the upper width.

7. The luggage case of claim 1, wherein the attachment member includes:

an extension portion extending from the base portion in a direction at least partially towards the secondary recess.

8. The luggage case of claim 1, wherein the base portion includes opposing sides and a slot is formed adjacent each opposing side of the base portion.

9. The luggage case of claim 8, wherein an auxiliary article is received in the slots.

10. The luggage case of claim 7, wherein the extension portion is positioned flush with or below a bottom wall of the primary recess.

11. The luggage case of claim 6, wherein the base portion defines a width greater than one third of the lower width.

12. The luggage case of claim 1, wherein the base portion tapers along its length.

13. The luggage case of claim 1, wherein the attachment member and the secondary recess are configured to position a portion of the auxiliary article at or below a wall of the primary recess.

14. The luggage case of claim 1, wherein the attachment member and secondary recess are configured to receive portions from at least one auxiliary article.

15. A luggage case comprising:

a main body including a lid shell and a base shell, wherein the lid shell and the base shell are hingedly coupled to one another and selectively closable by a closure mechanism;

a primary recess formed on the luggage case, the primary recess including:

a secondary recess formed in a wall of the primary recess; and an attachment member positioned over a portion of the secondary recess, the attachment member comprising a base portion extending from the secondary recess; and a retractable tow handle operably coupled to the luggage case extendable from and retractable into the primary recess, wherein the attachment member is configured to engage a portion of an auxiliary article and the secondary recess is configured to receive the portion of the auxiliary article.

16. The luggage case of claim 15, wherein the attachment member is in contact with or below the retractable tow handle.

17. The luggage case of claim 15, wherein the attachment member includes:

an extension portion extending from the base portion in a direction at least partially towards the secondary recess, wherein an outer surface of the extension portion is at or below a base wall of the primary recess.

18. The luggage case of claim 15, wherein the primary recess and secondary recess are integrally formed in a bezel, the bezel positioned adjacent an intersection between a top panel and a main panel of one of the shells.

19. The luggage case of claim 15, wherein slots are formed adjacent each opposing side of the attachment member and a wall of the secondary recess.

* * * * *